US006217022B1

(12) United States Patent
Astaneha

(10) Patent No.: US 6,217,022 B1
(45) Date of Patent: Apr. 17, 2001

(54) GAMBLING GAME

(76) Inventor: Morteza Astaneha, 77 Prospect Ave., Apt. 4-1, Hackensack, NJ (US) 07601

( * ) Notice: Subject to any disclaimer, the term of this patent is extended or adjusted under 35 U.S.C. 154(b) by 0 days.

(21) Appl. No.: 09/330,653

(22) Filed: Jun. 11, 1999

(51) Int. Cl.[7] ..... A63F 5/04

(52) U.S. Cl. ..... 273/138.1; 273/274; 273/142 R; 273/142 HA

(58) Field of Search ..... 273/138.1, 139, 273/142 R, 142 G, 142 D, 142 H, 142 HG, 274, 236

(56) References Cited

U.S. PATENT DOCUMENTS

| | | | |
|---|---|---|---|
| D. 106,967 | | 11/1937 | Danon . |
| D. 275,116 | | 8/1984 | Mickens . |
| 1,892,664 | * | 1/1933 | Eyles . |
| 2,036,718 | * | 4/1936 | Potter . |
| 2,065,424 | * | 12/1936 | Brubaker . |
| 2,077,124 | * | 4/1937 | Miller . |
| 2,253,787 | | 8/1941 | Kelly . |
| 2,283,583 | * | 5/1942 | Singer . |
| 2,370,229 | | 2/1945 | Buckley . |
| 3,913,919 | | 10/1975 | Carpenter . |
| 3,975,022 | | 8/1976 | Figueroa . |
| 4,077,631 | | 3/1978 | Tela, Jr. . |
| 4,149,728 | | 4/1979 | Thompson . |
| 4,247,114 | | 1/1981 | Carroll . |
| 4,346,900 | | 8/1982 | Lamlee . |
| 4,941,665 | * | 7/1990 | Klamer . |
| 5,102,135 | | 4/1992 | Addiechi . |
| 5,118,110 | * | 6/1992 | Jones . |
| 5,133,559 | | 7/1992 | Page . |
| 5,232,222 | * | 8/1993 | Deutch . |
| 5,540,442 | * | 7/1996 | Orselli . |
| 5,584,763 | | 12/1996 | Kelly et al. . |
| 5,636,838 | * | 6/1997 | Caro . |
| 5,785,596 | | 7/1998 | Hobert . |

* cited by examiner

*Primary Examiner*—Benjamin H. Layno
*Assistant Examiner*—V K Mendiratta
(74) *Attorney, Agent, or Firm*—Richard M. Goldberg

(57) ABSTRACT

A gambling game includes a housing; a first wheel of a first diameter rotatably mounted in the housing and having an exposed surface with a first plurality of numbers on a circumferential area thereof and a plurality of colors, each associated with one number; a second wheel of a second diameter smaller than the first diameter and rotatably mounted in the housing and within the first wheel, the second wheel having an exposed surface with a second plurality of numbers on a circumferential area thereof and a plurality of colors, each associated with one number; first and second flexible pointers for indicating one number and one color on the first wheel and one number and one color on the second wheel after rotation of the first and second wheels; and a single wagering area for both wheels, including boxed areas for wagering on individual numbers from the first and second wheels which are indicated by the indicating arrangement; at least one numerical outcome from an arithmetic operation of multiplication, addition or subtraction performed between the two numbers from the first and second wheels which are indicated by the indicating arrangement; and individual colors and color combinations which are indicated by the indicating arrangement.

15 Claims, 7 Drawing Sheets

| 60 | 62 | 64 | 66 | 68 | 70 | 72 | 74 | 76 |
|---|---|---|---|---|---|---|---|---|
| 1 | 2 | 3 | 4 | ROW | 1-10 | 1-20 | GREEN | BLUE-ORANGE |
| 5 | 6 | 7 | 8 | ROW | | | | |
| 9 | 10 | 11 | 12 | ROW | | 21-40 | | |
| 13 | 14 | 15 | 16 | ROW | 11-20 | | BLUE | YELLOW-ORANGE |
| 17 | 18 | 19 | 20 | ROW | | EVEN | | |
| 21 | 22 | 23 | 24 | ROW | | ODD | | |
| 25 | 26 | 27 | 28 | ROW | 21-30 | ORANGE | BLUE-YELLOW | GREEN-BLUE |
| 29 | 30 | 31 | 32 | ROW | | | | |
| 33 | 34 | 35 | 36 | ROW | | | | |
| 37 | 38 | 39 | 40 | ROW | 31-40 | YELLOW | ORANGE-GREEN | GREEN-YELLOW |
| COL | COL | COL | COL | | | | | |
| 2:1 | 3:1 | + | - | 0 | | | | |

FIG. 5

| | | | | | | |
|---|---|---|---|---|---|---|
| 1 | 2 | 3 | 4 | ROW | 1-12 | 1-18 |
| 5 | 6 | 7 | 8 | ROW | | |
| 9 | 10 | 11 | 12 | ROW | | 19-36 |
| 13 | 14 | 15 | 16 | ROW | 13-24 | |
| 17 | 18 | 19 | 20 | ROW | | EVEN |
| 21 | 22 | 23 | 24 | ROW | | ODD |
| 25 | 26 | 27 | 28 | ROW | 25-36 | WHITE |
| 29 | 30 | 31 | 32 | ROW | | |
| 33 | 34 | 35 | 36 | ROW | | |
| COL | COL | COL | COL | | BLACK | BLACK-WHITE |
| 2:1 | 3:1 | MULTIPLY | | | | |

158

FIG. 7

<table>
<tr><td>1</td><td>2</td><td>3</td><td>4</td><td>ROW</td><td rowspan="3">1-12</td><td rowspan="2">1-18</td><td rowspan="3">BLUE-GREEN</td></tr>
<tr><td>5</td><td>6</td><td>7</td><td>8</td><td>ROW</td></tr>
<tr><td>9</td><td>10</td><td>11</td><td>12</td><td>ROW</td><td rowspan="3">19-36</td></tr>
<tr><td>13</td><td>14</td><td>15</td><td>16</td><td>ROW</td><td rowspan="3">13-24</td><td rowspan="3">BLUE-RED</td></tr>
<tr><td>17</td><td>18</td><td>19</td><td>20</td><td>ROW</td><td>EVEN</td></tr>
<tr><td>21</td><td>22</td><td>23</td><td>24</td><td>ROW</td><td>ODD</td></tr>
<tr><td>25</td><td>26</td><td>27</td><td>28</td><td>ROW</td><td rowspan="3">25-36</td><td rowspan="3">GREEN</td><td rowspan="3">RED-GREEN</td></tr>
<tr><td>29</td><td>30</td><td>31</td><td>32</td><td>ROW</td></tr>
<tr><td>33</td><td>34</td><td>35</td><td>36</td><td>ROW</td></tr>
<tr><td>COL</td><td>COL</td><td>COL</td><td>COL</td><td></td><td rowspan="2">BLUE</td><td rowspan="2">RED</td><td rowspan="2">RED-GREEN-BLUE</td></tr>
<tr><td>2:1</td><td>3:1</td><td colspan="3">MULTIPLY</td></tr>
</table>

158

GAMBLING GAME

BACKGROUND OF THE INVENTION

The present invention relates generally to a roulette-type or wheel of fortune type gambling game, and more particularly, is directed to a roulette-type or wheel of fortune type gambling game that provides more variations in play and in wagering.

In a conventional roulette game, there is a rotatable roulette wheel that has numbered pockets with numbers "1" through "36", "0" and "00" therein. The pockets with numbers "0" and "00" give the house or dealer an advantage of 5.26%. Each pocket is separated from its neighbors by metal dividers. Half of the 36 numbers are black while the other half are red. The pockets containing the numbers "0" and "00" are green. The numbers are not in consecutive order, but rather, are in random order, with red and black numbers alternating, except when broken up by "0" and "00".

There are numerous possible wagers that can be made, which are paid off at different odds. For example, for even money, that is 1:1 pay off, there are wagers on odd numbers, even numbers, red numbers, black numbers, a range of low numbers "1" through "18" and a range of high numbers "19" through "36". For higher odds, such as 35:1, a player can wager on a single number, while wagers on two numbers pay off at 17:1; wagers on three numbers pay off at 11:1; wagers on four numbers pay off at 8:1; wagers on five numbers pay off at 6:1; wagers on six numbers pay off at 5:1; wagers on dozens, such as "1" through "12", "13" through "24" or "25" through "36" pay off at 2:1, as would wagers on one of the three columns of numbers.

However, gambling with a roulette wheel by itself can become boring or tiresome over time. Specifically, there is only one item moving at a time, namely, a single ball about a single wheel. Third, although there is some variation in the types of wagers that can be made, the types of wagers are still somewhat limited. As a result, the players can become easily bored after a short time, and retire from the game, which is undesirable to the casino.

The same comments apply to other roulette-type games, such as wheel of fortune games in casinos, in which the dealer spins a wheel having arcuate segments thereon, and a flexible pointer is provided to eventually stop the wheel and point to a particular segment having a monetary amount listed thereon. Such games are even less interesting, since there is no color aspect thereto.

OBJECTS AND SUMMARY OF THE INVENTION

Accordingly, it is an object of the present invention to provide a gambling game that overcomes the problems with the aforementioned prior art.

It is another object of the present invention to provide a gambling game with an increased number and variation of ways to wager.

It is still another object of the present invention to provide a roulette-type gambling game in which there are two separately rotatable wheels, each having numbers and colors thereon.

It is yet another object of the present invention to provide a roulette-type gambling game in which a summation or multiplication action is provided between the numbers on the two wheels for enhanced wagering.

It is a further object of the present invention to provide a roulette-type gambling game in which there are a plurality of different colors that can be bet on, for enhanced wagering.

It is a still further object of the present invention to provide a gambling game in which the players can easily understand the different wagers that can be made.

It is a yet further object of the present invention to provide a gambling game in which the principles thereof are extendible to other gambling games, such as dice games.

It is another further object of the present invention to provide a gambling game that is easy and economical to use and manufacture.

In accordance with an aspect of the present invention, In accordance with an aspect of the present invention, a gambling game includes a housing; a first wheel of a first diameter rotatably mounted in the housing and having an exposed surface with a first plurality of numbers on a circumferential area thereof; a second wheel of a second diameter smaller than the first diameter and rotatably mounted in the housing, the second wheel having an exposed surface with a second plurality of numbers on a circumferential area thereof; an indicating arrangement for indicating one number on the first wheel and one number on the second wheel after rotation of the first and second wheels; and a single common wagering area for both the first and second wheels, the single common wagering area including boxed areas for wagering on individual numbers from the first and second wheels which are indicated by the indicating arrangement; and at least one numerical outcome from an arithmetic operation performed between the two numbers from the first and second wheels which are indicated by the indicating arrangement.

The arithmetic operation is at least one of a multiplication operation, addition operation and subtraction operation. If it is a multiplication operation, each of the first and second wheels includes numbers "1" through "n" thereon, and the wagering area including boxes with numbers "1" through "n" times "n". If it is an addition operation and subtraction operation, the first wheel includes numbers "1" through "m" thereon, the second wheel includes numbers "1" through "n" thereon, and the wagering area includes boxes with numbers "1" through "m" plus "n".

The indicating arrangement includes a first flexible pointer mounted on a support adjacent the rotatable first wheel for pointing to a number on the first wheel and a second flexible pointer mounted on a support adjacent the rotatable second wheel for pointing to a number on the second wheel.

The first wheel includes a central recess therein, and the second wheel is positioned within the central recess for rotation therein.

Each wheel is divided into a plurality of sectors around a circumferential area thereof, with each sector having one number associated therewith. Each number also has one of a plurality of colors associated therewith such that the indicating arrangement also indicates one color from each wheel. In such case, the single wagering area also includes boxed areas for wagering on individual colors and color combinations in view of the colors indicated by the indicating arrangement.

In accordance with another aspect of the present invention, a gambling game includes a housing; a first wheel of a first diameter rotatably mounted in the housing and having an exposed surface with a first plurality of numbers on a circumferential area thereof and a plurality of colors, each associated with one number; a second wheel of a second diameter smaller than the first diameter and rotatably mounted in the housing, the second wheel having an exposed surface with a second plurality of numbers on a circumferential area thereof and a plurality of colors, each associated with one number; an indicating arrangement for indicating one number and one color on the first wheel and one number and one color on the second wheel after rotation of the first and second wheels; and a single common wagering area for both the first and second wheels, the single common wagering area including boxed areas for wagering on individual numbers from the first and second wheels which are indicated by the indicating arrangement; at least one numerical outcome from an arithmetic operation performed between the two numbers from the first and second wheels which are indicated by the indicating arrangement; and individual colors and color combinations which are indicated by the indicating arrangement.

Each wheel is divided into a plurality of sectors around a circumferential area thereof, with each sector having one number and one the color associated therewith.

In accordance with still another aspect of the present invention, a gambling game includes a housing; first and second dice, each die having a plurality of surfaces, at least two of the surfaces of each die having different colors thereon, and the different surfaces of each die having different numbers thereon; and a single common wagering area on the housing for both dice, said wagering area including boxed areas for wagering on individual numbers from upper surfaces of the first and second dice; at least one numerical outcome from a multiplication operation performed between the two numbers from the upper surfaces of the first and second dice; and individual colors and color combinations from the upper surfaces of the first and second dice.

The above and other objects, features and advantages of the invention will become readily apparent from the following detailed description thereof which is to be read in connection with the accompanying drawings.

BRIEF DESCRIPTION OF THE DRAWINGS

FIG. 5 is a top plan view of a single wagering area for the gambling game of FIG. 4;

FIG. 7 is a top plan view of a single wagering area for the gambling game of FIG. 6;

DETAILED DESCRIPTION

Figure 1:
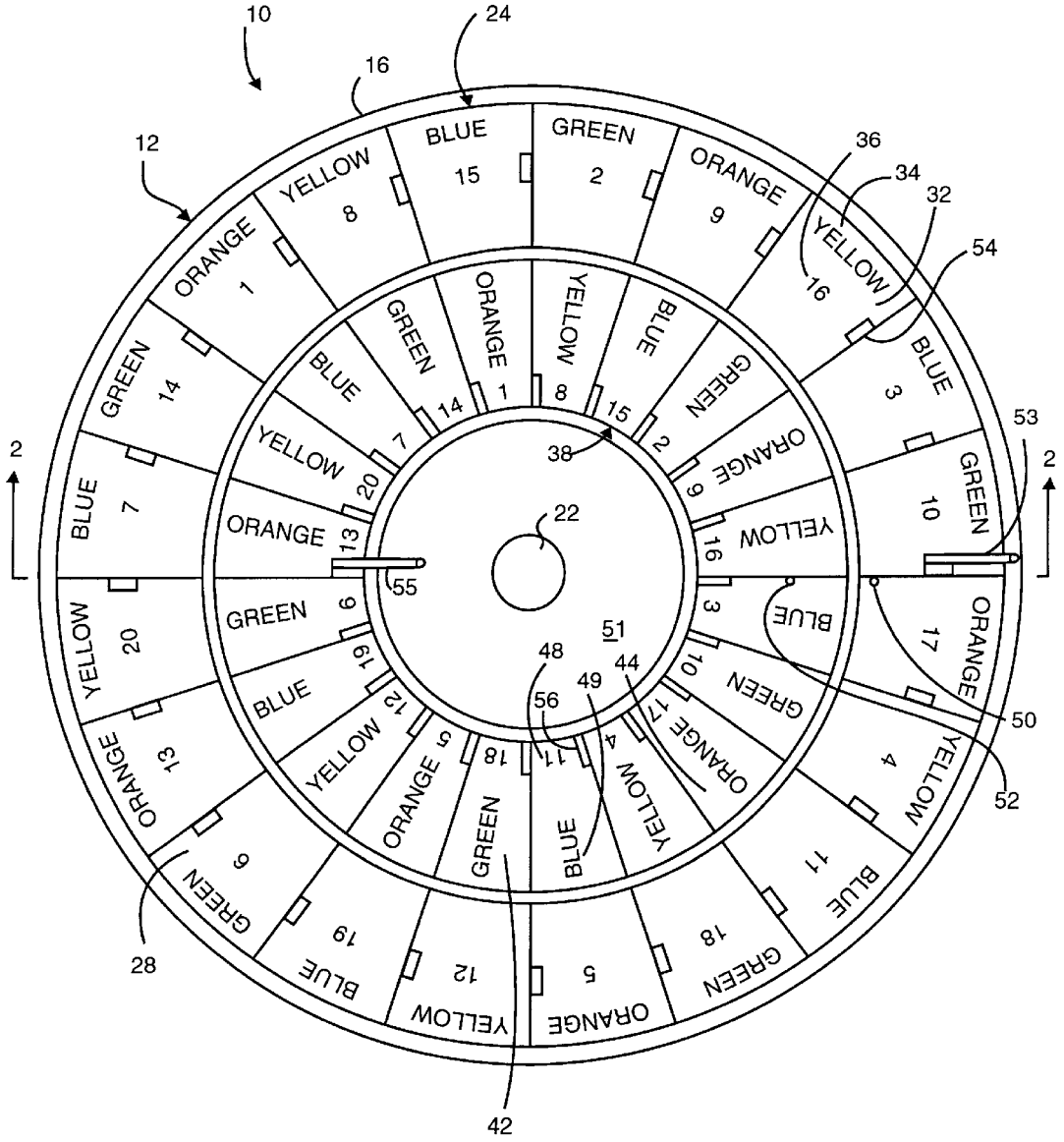
FIG. 1 is a top plan view of a gambling game according to a first embodiment of the present invention.
Figures 2, 3:
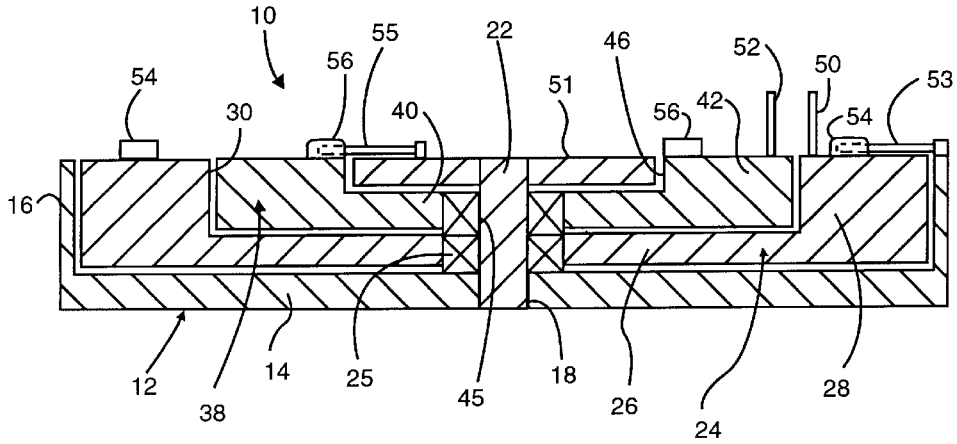
FIG. 2 is a cross-sectional view of the gambling game of FIG. 1.
FIG. 3 is a top plan view of a single wagering area for the gambling game of FIG. 1.

Referring to the drawings in detail, and initially to FIGS. 1 and 2 thereof, a gambling game 10 according to a first embodiment of the present invention includes a circular housing 12 formed by a flat circular wall 14 for supporting game 10 on a table or the like, and an upstanding peripheral side wall 16 extending around the periphery of flat circular wall 14. A central opening 18 is provided in flat circular wall 14 and has a shaft 22 fixedly mounted therein.

A first annular wheel 24 is rotatably mounted on shaft 22 by means of a circular bearing 25, at a position above flat circular wall 14. First annular wheel 24 includes a thin annular central section 26 and a raised annular outer section 28, such that a circular recess 30 is formed within annular outer section 28. Annular outer section 28 has outer dimensions slightly smaller than the inner dimensions of upstanding peripheral side wall 16 so as to fit therein and permit rotation of first annular wheel 24 therein.

As shown in FIG. 1, the upper surface of annular outer section 28 has a plurality of arcuate sectors 32 printed or otherwise formed thereon. Each sector 32 has a number 36 imprinted thereon, with the numbers 36 preferably being from 1 through 20, arranged in a random order. Also, each sector 32 has a color 34 imprinted thereon, such as ORANGE, YELLOW, BLUE or GREEN. Alternatively, the sectors 32 can be colored with particular color, rather than imprinted with the color. Although only twenty numbers and four colors are shown, there may be more or less than 20 numbers and four colors, and the present invention is not so limited.

A second annular wheel 38 is rotatably mounted on shaft 22 by means of a circular bearing 45, at a position above thin annular central section 26 and within raised annular outer section 28, that is, within circular recess 30.

Second annular wheel 38 includes a thin annular central section 40 and a raised annular outer section 42, such that a circular recess 46 is formed within annular outer section 42. Annular outer section 42 has outer dimensions slightly smaller than the inner dimensions of annular outer section 28 so as to fit therein and permit rotation of second annular wheel 38 therein.

As shown in FIG. 1, the upper surface of annular outer section 42 has a plurality of arcuate sectors 44 printed or otherwise formed thereon. Each sector 44 has a number 48 imprinted thereon, with the numbers 48 preferably being from 1 through 20, arranged in a random order. Also, each sector 44 has a color 49 imprinted thereon, such as ORANGE, YELLOW, BLUE or GREEN. Alternatively, the sectors 44 can be colored with particular color, rather than imprinted with the color. Although only twenty numbers and four colors are shown, there may be more or less than 20 numbers and four colors, and the present invention is not so limited.

Further, an annular support disk 51 is fixedly mounted to shaft 22 within circular recess 46.

In order to rotate first wheel 24 and second wheel 38, any suitable arrangement can be provided. As an example, a first raised rod arm 50 is provided near the inner periphery of one sector 32 of first wheel 24, and a second raised rod arm 52 is provided near the outer periphery of one sector 44 of second wheel 38, both of which can be engaged and used for spinning first wheel 24 and second wheel 38.

It is also necessary to stop wheels 24 and 38 from rotating and to also provide an indicator of one sector 32 and one sector 44 for each wheel.

In this regard, a flexible pointer 53 is fixed at one end to the upper edge of upstanding peripheral side wall 16 and extends radially inward over the upper surface of raised annular outer section 28, so as to hit against metal divider walls 54 mounted at an edge of each sector 32, as first annular wheel 24 is rotated. Each time that the end of flexible pointer 53 hits a divider wall 54, pointer 53 flexes to permit the respective metal divider wall 54 to pass by, whereupon the end of flexible pointer 53 hitting against divider walls 54 functions to slow down first annular wheel 24, and eventually cause first annular wheel 24 to stop. At such time, the end of flexible pointer 53 remains in a particular sector 32, to indicate both a number and a color therein.

In like manner, a flexible pointer 55 is fixed at one end to the upper edge of annular support disk 51 and extends radially outward over the upper surface of raised annular outer section 42, and hits against metal divider walls 56 mounted at an edge of each sector 44 as second annular wheel 38 is rotated. Each time that the end of flexible pointer 55 hits against a divider wall 56, pointer 55 flexes to permit the respective metal divider wall 56 to pass by, whereupon the end of flexible pointer 55 hitting against divider walls 56 functions to slow down second annular wheel 38, and eventually cause second annular wheel 38 to stop. At such time, the end of flexible pointer 55 remains in a particular sector 44, to indicate both a number and a color therein.

In accordance with the present invention, a single common wagering area 58 is provided for both wheels 24 and 38, as shown in FIG. 3. Wagering area 58 includes different columns 60, 62, 64, 66, 68, 70, 72, 74 and 76, by which a player can place different bets, based on both colors and numbers, from a combination due to the spinning of first wheel 24 and second wheel 38. Each column is separated into a plurality of boxes 78 having indicia thereon.

Thus, column 60 contains boxes 78 with numerical indicia "1", "5", "9", "13", "11", "21", "25", "29", "33" and "37", as well as a box containing the word COLUMN or the abbreviation COL therein to designate all of the numbers in column 60. There is also a box designated "2:1" to indicate that the person desires to receive a double payout if he wins.

In like manner, column 62 contains boxes 78 with numerical indicia "2", "6", "10", "14", "18", "22", "26", "30", "34" and "38", as well as a box containing the word COLUMN or the abbreviation COL therein to designate all of the numbers in column 62. There is also a box designated "3:1" to indicate that the person desires to receive a triple payout if he wins.

Column 64 contains boxes 78 with numerical indicia "3", "7", "11", "15", "19", "23", "27", "31", "35" and "39", as well as a box containing the word COLUMN or the abbreviation COL therein to designate all of the numbers in column 64. There is also a box designated "+" to indicate that the person desires to wager on the summation of numbers from first wheel 24 and second wheel 38. This latter box is an important aspect of the present invention and is discussed in more detail hereinafter.

Column 66 contains boxes 78 with numerical indicia "4", "8", "12", "16", "20", "24", "28", "32", "36" and "40", as well as a box containing the word COLUMN or the abbreviation COL therein to designate all of the numbers in column 66. There is also a box designated "–" to indicate that the person desires to wager on the subtraction of numbers from first wheel 24 and second wheel 38. In the event that the result of the subtraction is "0", the person can also wager on a box in column 68 as to the same. This latter box is an important aspect of the present invention and is discussed in more detail hereinafter.

Column 68 also contains boxes which indicate that the row is selected. For example, the uppermost "ROW" box would wager that a number from either wheel 24 or 38 is "1", "2", "3" or "4".

In column 70, a person can wager on groups of numbers 1–10, 11–20, 21–30 and 31–40, while larger groups of 1–20 and 21–40 can be wagered by placing chips in respective boxes in column 72.

The player can also wager on two possible number combinations, for example, by placing a chip to straddle the number boxes 78 containing two numbers, for example, the numbers "3" and "4". A wager on four number combinations can also be made by placing a chip at the meeting corner of the number boxes 78 containing the four number combinations, for example, the boxes 78 containing the number combinations "2", "3", "6" and "7".

Finally, another group of numbers that can be wagered is the ODD group or EVEN group of numbers, as per boxes in column 72.

A person can also wager on individual colors ORANGE, YELLOW, GREEN and BLUE, in respective boxes in columns 72 and 74, or on color combinations BLUE-YELLOW, ORANGE-GREEN, BLUE-ORANGE, YELLOW-ORANGE, GREEN-BLUE or GREEN-YELLOW, that is, wagering on the probability that two of the colors will be indicated on first wheel 24 and second wheel 38.

An important aspect of the present invention is, in addition to the color and number variations, the interaction of the numbers on wheel 24 and wheel 38 by summation of the numbers as a result of wagering in the "+" box, or subtraction of the numbers wagering in the "–" box. As a result, a compact roulette or wheel of fortune type gambling type game is provided, with two wheels 24 and 38, and with the variations being increased over a conventional roulette game, or even over two separate roulette or wheel of fortune games that would require two separate wagering areas.

In operation, wagering occurs by placing chips on the selective boxes. To distinguish from the summation or subtraction outcomes, the chips for wagering on single number boxes or groups of boxes can be of one color, while the chips for wagering on the summation or subtraction options of the different boxes can be of another color. Then, both wheels 24 and 38 are rotated by the dealer. When wheels 24 and 38 stop rotating, pointers 53 and 55 designate one number and one color from each wheel 24 and 38. It is then determined if anyone has won by referring to the chips placed on single common wagering area 58.

Figure 4:
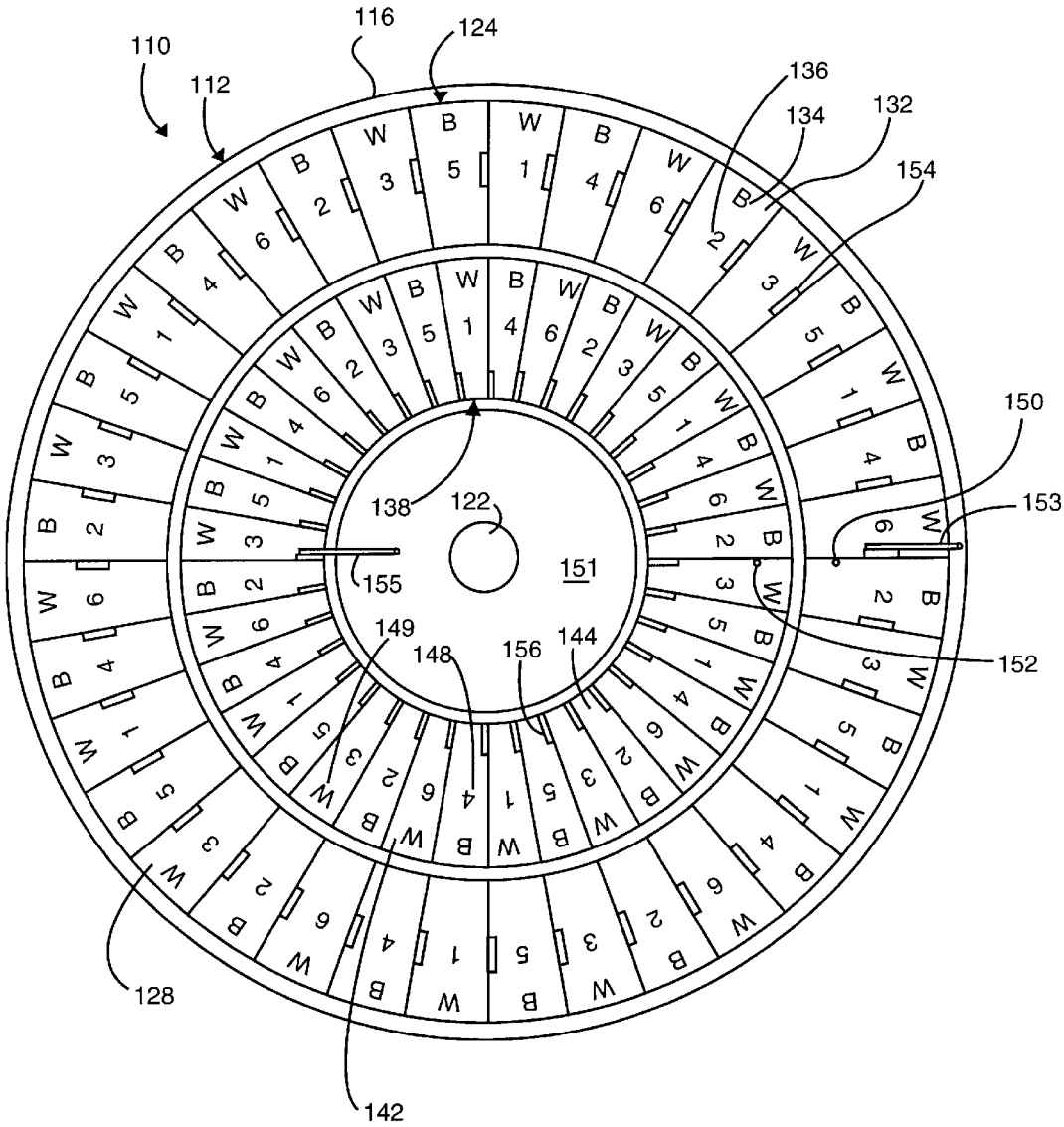
FIG. 4 is a top plan view of a gambling game according to a second embodiment of the present invention.

A gambling game 110 according to a second embodiment of the present invention will now be described in relation to FIGS. 4 and 5, in which elements corresponding to gambling game 10 are identified by the same reference numerals but augmented by 100, and a detailed explanation of the common elements is deleted for the sake of brevity.

Gambling game 110 includes a construction identical to that of gambling game 10. However, there are thirty-six sectors 132 and thirty-six sectors 144, each with a plurality of numbers ranging from "1" to "6", and preferably arranged in a random order. A BLACK or WHITE color is also associated with each sector 132 and 144, as in a conventional roulette game.

In this regard, wagering occurs with respect to individual numbers, a multiplication of one indicated number from each wheel 124 and 138, individual colors and a combination of colors. As a result of the interaction of the numbers from the two wheels by means of a multiplication operation, wagering can thus occur by groups of numbers 1–2, 13–24, 25–36, 1–18, 19–36 and ODD and EVEN numbers, as well as two adjacent numbers and four adjacent numbers, in the same manner as in the first embodiment. Wagering can also be made as to individual colors or groups of colors, as in the first embodiment.

An important aspect of the present invention, is therefore the wagering in single common wagering area 158 with respect to a multiplication of an indicated number 136 on first wheel 124 and an indicated number 148 on second wheel 138, for a possible thirty-six different combinations. This occurs by placing a chip in the MULTIPLY box, which takes the place of the "+", "−" and "0" boxes of the first embodiment of FIG. 3.

To distinguish wagering from an indicated number on either first wheel 124 or second wheel 138, from the multiplication operation, the chips for wagering on an indicated number from either wheel can be of one color, while the chips for wagering on the result of a multiplication operation between the two indicated numbers can be of another color.

As a result, a compact roulette or wheel of fortune type game is provided, with two wheels 24 and 38, and with the variations being increased over a conventional roulette or wheel of fortune game, or even over two separate roulette or wheel of fortune games with two separate wagering areas.

In operation, wagering occurs by placing chips on the selective boxes. To distinguish from the multiplication outcome, the chips for wagering on single numbers for either wheel can be of one color, while the chips for wagering on the multiplication operation can be of another color. Then, both wheels 124 and 138 are rotated by the dealer. When wheels 124 and 138 stop rotating, pointers 153 and 155 designate one number and one color from each wheel 124 and 138. It is then determined if anyone has won by referring to the chips placed on single common wagering area 158.

It will therefore be appreciated that the present invention provides a gambling game with an increased number and variation of ways to wager, by providing two separately rotatable wheels, each having numbers and colors thereon. Specifically, this occurs by a summation or multiplication of the numbers from the two different wheels to provide an interaction therebetween for enhanced wagering. In addition, there are a plurality of different colors that can be bet on, for enhanced wagering.

Figure 6:
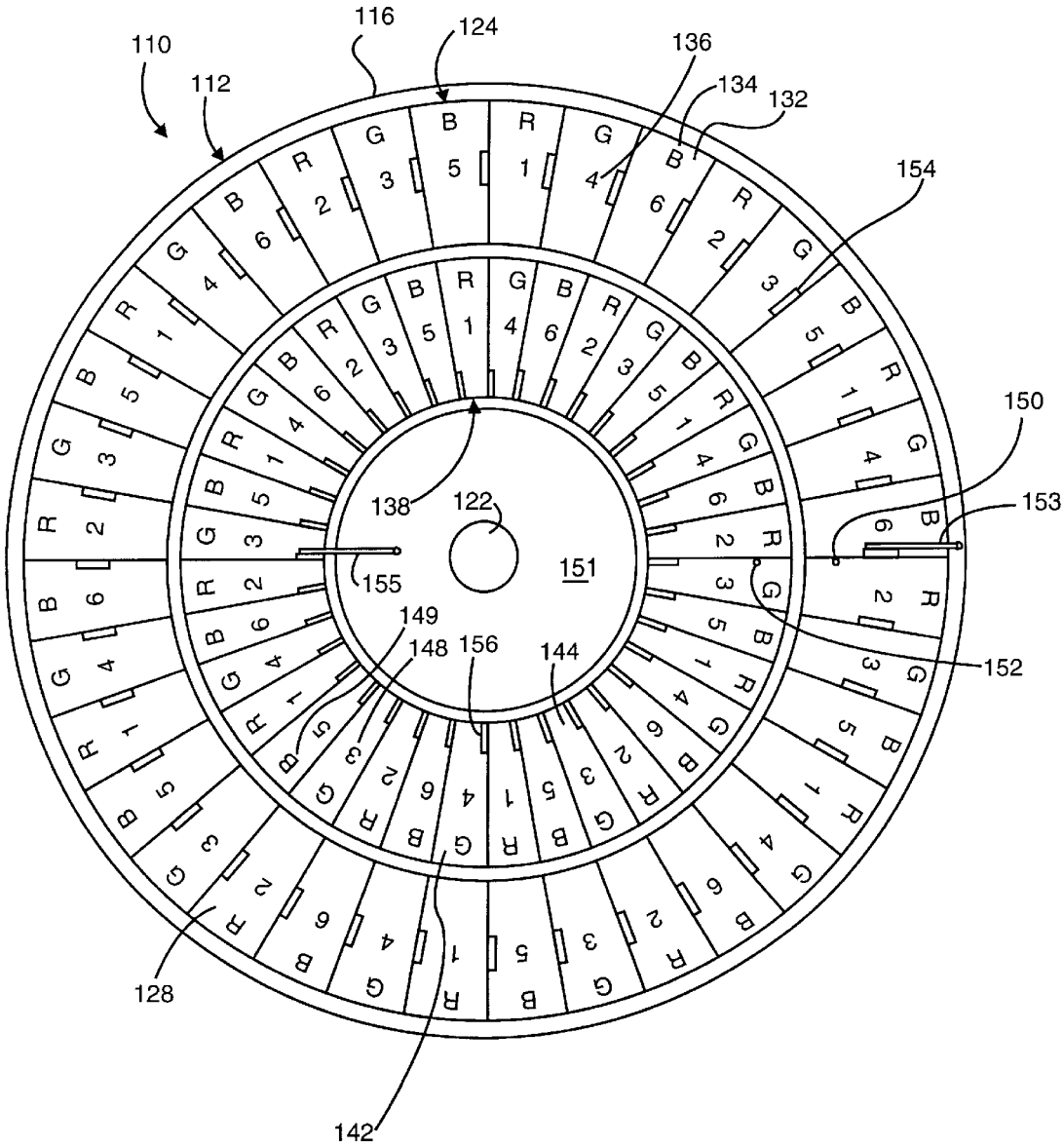
FIG. 6 is a top plan view of a gambling game according to a modification of the second embodiment of the present invention.

It will be appreciated that various modifications can be made thereto. For example, wagering area 158 shows only two colors, namely BLACK (B) and WHITE (W). However, more than two colors can be provided, as shown in FIGS. 6 and 7 in which three colors RED (R), GREEN (G) and BLUE (B) are provided, to enhance the variations in wagering still further.

Figure 8:
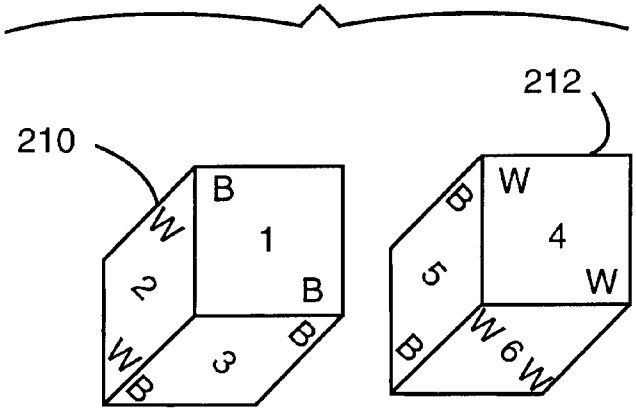
FIG. 8 is a perspective view of a pair of dice for a gambling game according to a third embodiment of the present invention.
Figure 9:
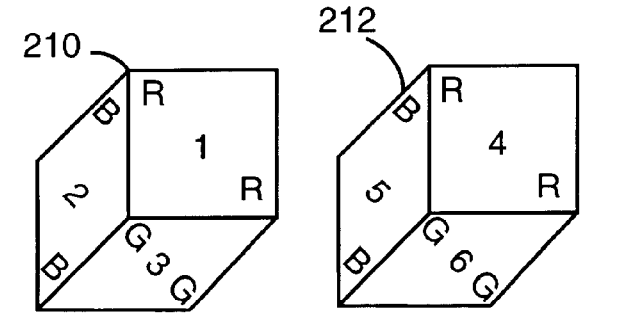
FIG. 9 is a perspective view of a gambling game according to a modification of the third embodiment of the present invention.

Although the second embodiment of the present invention has been discussed relative to a roulette or wheel or fortune type game, it will be appreciated that the present invention according to the second embodiment can also be applied to a dice game in which the numbers on the upper faces of the dice can be multiplied together in the same manner. In such case, a pair of dice 210 and 212 can be provided with different colors BLACK (B) and WHITE (W), as shown in FIG. 8, or different colors RED (R), GREEN (G) and BLUE (B), as shown in FIG. 9, on the different faces to provide wagering on the same number and color combinations as in the second embodiment of FIGS. 4–7.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A gambling game comprising:

a housing;

a first wheel of a first diameter rotatably mounted in said housing and having an exposed surface with a plurality of first numbers on a circumferential area thereof;

a second wheel of a second diameter smaller than said first diameter and rotatably mounted in said housing, said second wheel having an exposed surface with a plurality of second numbers on a circumferential area thereof;

an arrangement for rotating said first wheel and said second wheel such that said first wheel rotates simultaneously and independently of said second wheel;

an indicating arrangement for indicating one first number on said first wheel and one second number on said second wheel after rotation of said first and second wheels; and a single common wagering area adjacent said housing for both said first and second wheels, said single common wagering area including boxed areas for wagering, said boxed areas including first boxed areas having said first individual numbers from said first wheel and said second individual numbers from said second wheel which are indicated by said indicating arrangement, and second boxed areas having third individual numbers corresponding to at least one numerical outcome from an arithmetic operation performed between a first number from the first wheel and a second number from the second wheel which are indicated by said indicating arrangement, with only one number being provided in each boxed area.

2. A gambling game according to claim 1, wherein said third individual numbers include numbers corresponding to at least one of a multiplication operation, addition operation and subtraction operation of said first and second numbers.

3. A gambling game according to claim 2, wherein the first wheel includes said first numbers, each in a range of "1" through "n" thereon, with "n" being an integer, and said second wheel includes said second numbers, each in a range of "1" through "n" thereon, with "n" being an integer, and said second boxes on said wagering area include said third numbers in a range of "1" through "n×n".

4. A gambling game according to claim 2, wherein the first wheel includes said first numbers, each in a range of "1" through "m" thereon, the second wheel includes said second numbers, each in a range of "1" through "n" thereon, where "m" and "n" are integers, and said second boxes on said wagering area include said third numbers in a range of "1" through "m×n".

5. A gambling game according to claim 1, wherein the indicating arrangement includes a first flexible pointer mounted on a support adjacent the rotatable first wheel for pointing to a number on the first wheel and a second flexible pointer mounted on a support adjacent the rotatable second wheel for pointing to a number on the second wheel.

6. A gambling game according to claim 1, wherein said first wheel includes a central recess therein, and said second wheel is positioned within said central recess for rotation therein.

7. A gambling game according to claim 1, wherein each said wheel is divided into a plurality of sectors around a circumferential area thereof, with each sector of the first wheel having one said first number associated therewith and each sector of the second wheel is number associate therewith.

8. A gambling game according to claim 7, wherein each sector also has one of a plurality of colors associated therewith such that said indicating arrangement also indicates one color from each wheel, and said single wagering area also includes third boxed areas for wagering on individual colors and color combinations in view of the colors indicated by the indicating arrangement, each third boxed area including at least one color designation corresponding to the plurality of colors in said sectors.

9. A gambling game comprising:

a housing;

a first wheel of a first diameter rotatably mounted in said housing and having an exposed surface with a plurality of first numbers on a circumferential area thereof and a plurality of colors, each color associated in juxtaposed relation with one number;

a second wheel of a second diameter smaller than said first diameter and rotatably mounted in said housing, said second wheel having an exposed surface with a plurality of second numbers on a circumferential area thereof and a plurality of colors, each color associated in juxtaposed relation with one number;

an arrangement for rotating said first wheel and said second wheel such that said first wheel rotates simultaneously and independently of said second wheel;

an indicating arrangement for indicating one first number and one color on said first wheel and one second number and one color on said second wheel after rotation of said first and second wheels; and a single common wagering area adjacent said housing for both the first and second wheels, the single common wagering area including boxed areas for wagering, said boxed areas including first boxed areas having said first individual numbers from said first wheel and said second individual numbers from said second wheel which are indicated by said indicating arrangement, second boxed areas having third individual numbers corresponding to at least one numerical outcome from an arithmetic operation performed between a first number from the first wheel and a second number from the second wheel which are indicated by said indicating arrangement, with only one number being provided in each boxed area, and third boxed areas for wagering on individual colors and color combinations which are indicated by said indicating arrangement, each third boxed area including at least one color designation corresponding to the plurality of colors on said first and second wheels.

10. A gambling game according to claim 9, wherein each said wheel is divided into a plurality of sectors around a circumferential area thereof, with each sector of said first wheel having one said first number and one said color associated therewith and each sector of said second wheel having one said second number and one said color associated therewith.

11. A gambling game according to claim 9, wherein said third individual numbers include numbers corresponding to at least one of a multiplication operation, addition operation and subtraction operation of said first and second numbers.

12. A gambling game according to claim 11, wherein the first wheel includes said first numbers, each in a range of "1", through "n" thereon, with "n" being an integer, and said second wheel includes said second numbers, each in a range of "1" through "n" thereon, with "n" being an integer, and said second boxes on said wagering area include said third numbers in a range of "1" through "n×n".

13. A gambling game according to claim 11, wherein the first wheel includes said first numbers, each in a range of "1" through "m" thereon, the second wheel includes said second numbers, each in a range of "1" through "n" thereon, where "m" and "n" are integers, and said second boxes on said wagering area include said third numbers in a range of "1" through "m×n".

14. A gambling game according to claim 9, wherein the indicating arrangement includes a first flexible pointer mounted on a support adjacent the rotatable first wheel for pointing to a number on the first wheel and a second flexible pointer mounted on a support adjacent the rotatable second wheel for pointing to a number on the second wheel.

15. A gambling game according to claim 9, wherein said first wheel includes a central recess therein, and said second wheel is positioned within said central recess for rotation therein.

* * * * *

Disclaimer and Dedication

6,217,022 B1—Morteza Astaneha, Hackensack, NJ (US). GAMBLING GAME. Patent dated April 17, 2001. Disclaimer and Dedication filed February 23, 2005 by the Inventor.

Hereby disclaims and dedicates to the Public, all claims and the entire term of said patent.

*(Official Gazette, June 19, 2007)*